US010954685B1

(12) United States Patent
Guo et al.

(10) Patent No.: US 10,954,685 B1
(45) Date of Patent: Mar. 23, 2021

(54) SELF-CENTERING CABLE WITH METAL-BASED ENERGY-DISSIPATION

(71) Applicant: SOUTHEAST UNIVERSITY, Nanjing (CN)

(72) Inventors: Tong Guo, Nanjing (CN); Jishuai Wang, Nanjing (CN); Yongsheng Song, Nanjing (CN)

(73) Assignee: SOUTHEAST UNIVERSITY, Nanjing (CN)

( * ) Notice: Subject to any disclaimer, the term of this patent is extended or adjusted under 35 U.S.C. 154(b) by 0 days.

(21) Appl. No.: 17/042,939

(22) PCT Filed: Sep. 13, 2018

(86) PCT No.: PCT/CN2018/105367
§ 371 (c)(1),
(2) Date: Sep. 29, 2020

(87) PCT Pub. No.: WO2019/184261
PCT Pub. Date: Oct. 3, 2019

(30) Foreign Application Priority Data

Mar. 30, 2018 (CN) ..... 201810294380.2

(51) Int. Cl.
*E04H 9/00* (2006.01)
*E04H 9/02* (2006.01)
*E04B 1/98* (2006.01)

(52) U.S. Cl.
CPC ..... *E04H 9/0237* (2020.05); *E04H 9/02* (2013.01); *E04B 1/98* (2013.01); *E04H 9/00* (2013.01); *E04H 9/024* (2013.01); *E04H 9/0235* (2020.05)

(58) Field of Classification Search
CPC ..... E04H 9/0237; E04H 9/00; E04H 9/02; E04H 9/0235; E04H 9/024; E04B 1/98;
(Continued)

(56) References Cited

U.S. PATENT DOCUMENTS 2,053,226 A * 9/1936 Ruge ..... E04H 9/02 52/113
5,347,771 A * 9/1994 Kobori ..... E04H 9/0237 52/167.1
(Continued)

FOREIGN PATENT DOCUMENTS

CN 103967158 A 8/2014
CN 105155718 A 12/2015
(Continued)

*Primary Examiner* — Phi D A
(74) *Attorney, Agent, or Firm* — Bayramoglu Law Offices LLC

(57) ABSTRACT

A self-centering cable includes a restoring and energy-dissipation unit and a cable reinforcement connected to the restoring and energy-dissipation unit by a connecting unit. The restoring and energy-dissipation unit includes an outer trough, an axial tube provided in an opening at the upper end of the outer trough, two inverted U-shaped mild steel members provided side by side and fixedly mounted in the outer trough, an axial pallet sandwiched between and fixedly connected to the two inverted U-shaped mild steel members, and a disc spring set provided in the outer trough and sleeved onto the axial tube. The cable reinforcement includes a tensile reinforcement penetrating into a reinforcement bottom connector and a reinforcement top connector. The reinforcement bottom connector is connected to the axial tube, the top end connector, connected to the reinforcement top connector, and a bottom end connector are connected to a structure to be reinforced.

9 Claims, 2 Drawing Sheets

(58) Field of Classification Search
CPC ... E04B 2/62; E04B 1/985; E04C 3/02; E04C 3/293
See application file for complete search history.

(56) References Cited

U.S. PATENT DOCUMENTS 5,890,705 A * 4/1999 Lee ..... E04H 9/021 267/150
5,946,866 A * 9/1999 Weglewski ..... E04H 9/022 52/167.1
5,964,327 A * 10/1999 Shih ..... G05D 19/02 188/380
6,226,935 B1 * 5/2001 Kuramochi ..... E04H 9/02 52/167.4
6,230,450 B1 * 5/2001 Kuroda ..... F16F 9/12 52/167.8
6,389,767 B1 * 5/2002 Lucey ..... E04B 1/24 52/223.1
6,510,660 B1 * 1/2003 Michioka ..... E04H 9/02 52/167.7
8,112,968 B1 * 2/2012 Mueller ..... E04C 2/384 52/800.12
2003/0042088 A1 * 3/2003 Braun ..... F16F 9/063 188/314
2005/0138870 A1 * 6/2005 Ishimura ..... E04H 9/0237 52/167.1
2005/0257451 A1 * 11/2005 Pryor ..... E04H 9/14 52/167.4
2005/0274084 A1 * 12/2005 Lin ..... E04H 9/02 52/167.1
2007/0006538 A1 * 1/2007 Chuang ..... F16F 3/023 52/167.4
2010/0011681 A1 * 1/2010 Chiang ..... E04H 9/0237 52/167.2
2011/0107699 A1 * 5/2011 Kawai ..... E04B 1/681 52/393
2012/0038091 A1 * 2/2012 Tagawa ..... E04H 9/021 267/136
2014/0115979 A1 * 5/2014 Kenho ..... E04H 9/021 52/167.7
2014/0130332 A1 * 5/2014 Partridge ..... F16L 3/06 29/525.01
2014/0174284 A1 * 6/2014 Peters ..... F41H 1/00 89/36.02
2015/0000228 A1 * 1/2015 Dusicka ..... E04G 23/0218 52/835
2015/0233113 A1 * 8/2015 Ueno ..... F16F 13/007 52/167.1
2016/0326742 A1 * 11/2016 Haque ..... E04B 1/98
2017/0030701 A1 * 2/2017 Saxey ..... G01B 7/18
2017/0067249 A1 * 3/2017 Matteson ..... E04G 23/0218
2017/0107734 A1 * 4/2017 Gray ..... F16F 7/128
2017/0145686 A1 * 5/2017 Lee ..... E04B 1/98
2018/0283487 A1 * 10/2018 Hattori ..... G02B 23/16
2019/0106899 A1 * 4/2019 McDermott ..... E04H 9/024
2019/0136564 A1 * 5/2019 Mart N Hern Ndez ..... F16F 15/085
2019/0264461 A1 * 8/2019 Cody ..... E04H 9/021

FOREIGN PATENT DOCUMENTS

CN 106760010 A 5/2017
CN 107542177 A 1/2018
DE 102007010701 A1 8/2008
JP 2012189104 A 10/2012
WO WO-2017048946 A1 * 3/2017 ..... F16F 9/20
WO WO-2017056265 A1 * 4/2017 ..... F16F 13/00
WO WO-2018230774 A1 * 12/2018 ..... F16F 13/005
WO WO-2019031669 A1 * 2/2019 ..... E04B 1/98

* cited by examiner

SELF-CENTERING CABLE WITH METAL-BASED ENERGY-DISSIPATION

CROSS REFERENCE TO THE RELATED APPLICATIONS

This application is the national phase entry of International Application No. PCT/CN2018/105367, filed on Sep. 13, 2018, which is based upon and claims priority to Chinese Patent Application No. 201810294380.2, filed on Mar. 30, 2018, the entire contents of which are incorporated herein by reference.

TECHNICAL FIELD

The present invention relates to a self-centering cable with metal-based energy-dissipation technology, and belongs to the field of seismic retrofit of civil engineering.

BACKGROUND

To improve the lateral stiffness of a structure and reduce damage to the structure caused by an earthquake, braces are often provided in the structure to increase the lateral stiffness of the structure and dissipate the seismic input energy. Existing ordinary braces may produce irreparable residual deformation under a strong earthquake and exert some adverse impacts on the structure. To avoid irreparable damage to the structure under a strong earthquake, self-restoring energy-dissipative braces come into being. At present, most existing self-restoring energy-dissipative braces are bidirectional load-carrying braces. To avoid compressive buckling and achieve resetting effect, the self-restoring energy-dissipative braces are often complex in configuration and expensive to build.

At present, main sources of restoring forces in restorable functional braces are disc springs, steel strands, fiber reinforced polymer (FRP) reinforcements, memory alloys, and the like. However, the steel strands and the FRP reinforcements have strict requirements for anchoring and may produce relatively large prestress losses during use, and memory alloy materials are expensive currently.

At present, energy-dissipative braces mostly use plastic deformation energy dissipation of metal, friction energy dissipation, and flow energy dissipation of viscous material. The plastic deformation energy dissipation of metal has stable performance and high reliability. The friction energy dissipation has the problems of easy aging of friction materials and a large difference between a maximum static friction force and a sliding friction force. The flow energy dissipation of viscous materials has disadvantages such as temperature sensitivity and leakage of viscous material. At present, the restorable functional braces have widespread problems such as a complex structure, a large self-weight, high costs, an unstable energy dissipation effect, and a low material strength utilization rate.

SUMMARY

The present invention provides a self-centering cable with metal-based energy-dissipation that reduces a self-weight and costs of a self-restoring energy-dissipative brace and that makes full use of strength of high-strength material and improves energy dissipation stability of the brace.

The self-centering cable with metal-based energy-dissipation of the present invention includes a restoring and energy-dissipation unit and a cable reinforcement connected to the restoring and energy-dissipation unit through a connecting unit, where the restoring and energy-dissipation unit includes an outer trough, an axial tube disposed in an upper-end opening of the outer trough, two inverted U-shaped mild steel members disposed side by side and fixedly mounted in the outer trough, an axial pallet sandwiched by and fixedly connected to the two inverted U-shaped mild steel members, and a disc spring set disposed in the outer trough and sleeved on the axial tube. The connecting unit includes a reinforcement-bottom connector and a reinforcement-top connector that are disposed at an upper end of the axial tube, a top-end connector, and a bottom-end connector, the cable reinforcement includes a tensile reinforcement, a reinforcement-top anchor head and a reinforcement-bottom anchor head are respectively disposed at an upper end and an lower end of the tensile reinforcement, the reinforcement-bottom connector is connected to the axial tube, the tensile reinforcement is anchored on the reinforcement-bottom connector through the reinforcement-bottom anchor head, the reinforcement-top connector is connected to the top-end connector, and the tensile reinforcement is anchored on the reinforcement-top connector through the reinforcement-top anchor head.

Further, in the device provided by the present invention, a lower end of the axial tube is connected to an end head of an upper end of the axial pallet in a screwed manner, a locking nut is mounted on the axial tube through an external screw thread provided at the upper end, a pre-pressure is applied to the disc spring set sleeved on the axial tube, and a compression amount and the pre-pressure of the disc spring set are adjusted by adjusting a length of the locking nut screwed into the axial tube.

Further, in the device provided by the present invention, the inverted U-shaped mild steel member is made of mild steel, is provided with holes at bottom ends of two side walls thereof, and is mounted in the outer trough through high-strength bolts, in addition, the two inverted U-shaped mild steel members and the axial pallet sandwiched between the two inverted U-shaped mild steel members are connected as a whole through another group of high-strength bolts, and an energy dissipation capacity of the self-centering cable with metal-based energy-dissipation is adjusted by adjusting the wall thickness and the width of the mild steel members.

Further, in the device provided by the present invention, the axial pallet has a T-shaped cross-section, including a vertical lower-end plate, a middle pallet disposed at a top of the lower-end plate and an end head disposed on an upper side of the middle pallet, the middle pallet supports the disc spring set, the end head is provided with an external screw thread, and the lower-end plate is disposed between the two inverted U-shaped mild steel members and is connected to the inverted U-shaped mild steel member through the high-strength bolts.

Further, in the device provided by the present invention, a bottom-end connector is disposed on a bottom side of the outer trough, the reinforcement-top connector is connected to a top-end connector, and the bottom-end connector and the top-end connector are separately connected to a structure to be reinforced by a pin shaft connection, to ensure axial force transmission of tie bar.

The self-centering cable with metal-based energy-dissipation of the present invention is a structural member in the field of seismic reinforcement of civil engineering and is disposed in two directions during use. The pre-compressed disc spring set is used for providing a restoring force for the energy dissipative cable, and plastic deformation of the inverted U-shaped mild steel members with relatively low yield strength are used for dissipating seismic energy. The high-strength, high-elastic elongation reinforcement is used as the tensile reinforcement. The self-centering cable with metal-based energy-dissipation uses plastic deformation of the inverted U-shaped mild steel member to dissipate seismic energy and provides a restoring force through the pre-compressed disc spring set. One end of the tensile reinforcement is connected to the axial tube through a reinforcement connector, and the other end of the tensile reinforcement is connected to a to-be-reinforced structure through a reinforcement connector and an end connector. An inner tube of the axial tube may be screwed into a screw-threaded end head of the axial pallet, and a screw-threaded end of a top of the axial tube may be screwed into the locking nut, to lock the pre-pressure of the disc spring set, and an inner wall of the top may be screwed into the reinforcement-bottom connector. The disc spring set is connected in series by the axial tube, and a quantity of disc springs of the disc spring set is set according to required stiffness. The disc spring set is disposed between a top end of the outer trough and the axial pallet, and the pre-pressure of the disc spring set may be adjusted by adjusting a distance by which the locking nut is screwed into the axial tube. The inverted U-shaped mild steel member is provided with holes respectively in lower side walls thereof, and is separately connected to the axial pallet and the outer trough through high-strength bolts. With the movement of the axial pallet, a plastic deformation region of the inverted U-shaped mild steel member continuously changes. After the tensile reinforcement passes through the reinforcement-bottom connector and the reinforcement-top connector, two ends of the tensile reinforcement are anchored by using the reinforcement-bottom anchor head and the reinforcement-top anchor head. The reinforcement-bottom connector is connected to the axial tube, the reinforcement-top connector is connected to the top-end connector, and a full cable is connected to the to-be-reinforced structure through the bottom-end connector and the top-end connector.

Compared with the existing self-restoring energy-dissipative braces, the present invention has the advantages of low costs, a simple structure, convenient installation, and stable energy dissipation and restoring capabilities. The self-centering cable with metal-based energy-dissipation avoids the problem of buckling under compression through bidirectional cross arrangement and uses high-strength material as the tensile reinforcement, thereby greatly reducing a self-weight and costs of a brace. The self-centering cable with metal-based energy-dissipation provides a restoring force by using a pre-compressed disc spring set, and the pre-pressure of the disc spring set may be precisely adjusted by tensioning the axial tube that connects the disc spring set in series to a specified displacement and tightening the locking nut. Using the pre-compressed disc spring set as a restoring material leads to higher stability and easier construction than using prestress reinforcement, and lower costs than using memory alloy as a restoring material. The self-centering cable with metal-based energy-dissipation uses plastic yielding of the inverted U-shaped mild steel member of which two side walls are sandwiched to dissipate the seismic energy. With the movement of the axial pallet, a plastic yielding section of the inverted U-shaped mild steel member continuously changes. Therefore, compared with other energy-dissipative metal braces with unchanged plastic yielding region, service life of energy-dissipative metal is greatly prolonged. All brace members of a self-centering cable with metal-based energy-dissipation may be all connected through the high-strength bolts, and assembly of the self-centering cable with metal-based energy-dissipation requires no tension device or welding device. Therefore, compared with other braces, the self-restoring metal cable brace can be installed conveniently and has high construction efficiency, and high safety.

In the accompanying drawings: 1—disc spring set, 2—outer trough, 3—axial tube, 4—axial pallet, 5—inverted U-shaped mild steel member, 6—locking nut, 7—reinforcement-bottom connector, 8—reinforcement-top connector, 9—bottom-end connector, 10—top-end connector, 11—high-strength bolt, 12—tensile reinforcement, 13—reinforcement-top anchor head, and 14—reinforcement-bottom anchor head.

DETAILED DESCRIPTION OF THE EMBODIMENTS

Figure 1:
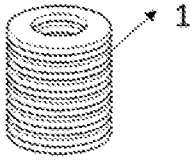
FIG. 1 is a schematic diagram of a disc spring set.
Figure 2:
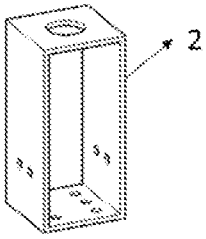
FIG. 2 is a schematic diagram of an outer trough.
Figure 3:
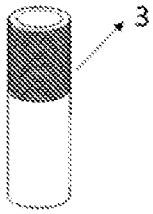
FIG. 3 is a schematic diagram of an axial tube.
Figure 4:
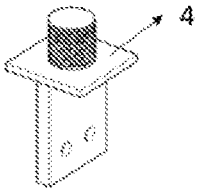
FIG. 4 is a schematic diagram of an axial pallet.
Figure 5:
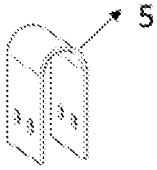
FIG. 5 is a schematic diagram of inverted U-shaped mild steel member.
Figure 6:
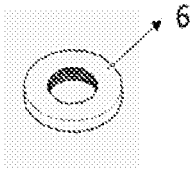
FIG. 6 is a schematic diagram of a locking nut.
Figure 7:
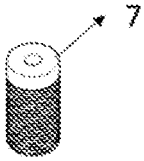
FIG. 7 is a schematic diagram of a reinforcement-bottom connector.
Figure 8:
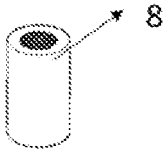
FIG. 8 is a schematic diagram of a reinforcement-top connector.
Figure 9:
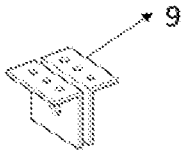
FIG. 9 is a schematic diagram of a bottom-end connector.
Figure 10:
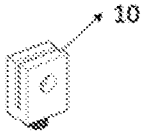
FIG. 10 is a schematic diagram of a top-end connector.
Figure 11:
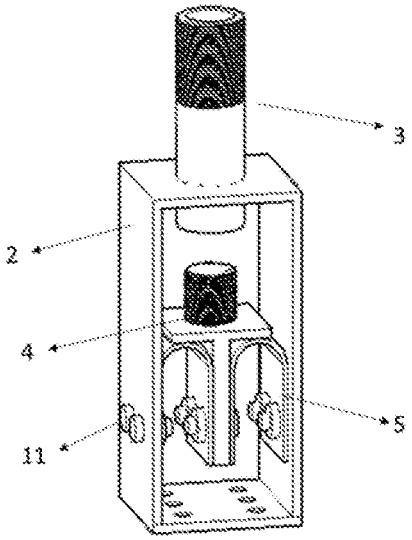
FIG. 11 is a schematic diagram of a restoring and energy-dissipation unit before installing a disc spring set.
Figure 12:
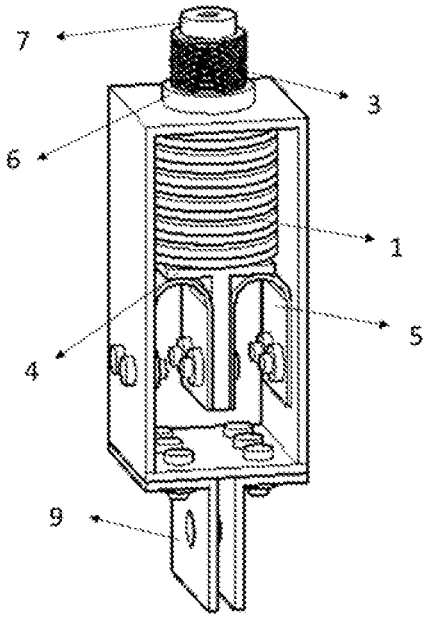
FIG. 12 is a schematic diagram of a restoring and energy-dissipation unit with a disc spring set.
Figure 13:
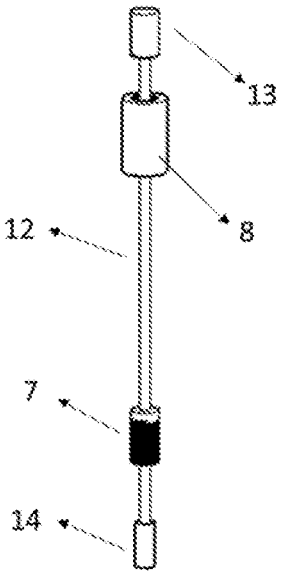
FIG. 13 is a schematic diagram of a connecting unit and tensile reinforcement.
Figure 14:
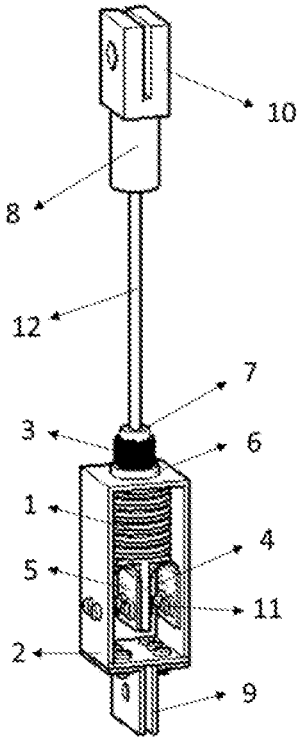
FIG. 14 is a schematic diagram of assembly of a tensile reinforcement, connecting unit, outer trough and disc spring set.

In the present invention, a self-centering cable with metal-based energy-dissipation includes a restoring and energy-dissipation unit, a connecting unit, and a tensile reinforcement. The restoring and energy-dissipation unit includes a disc spring set 1 that provides a restoring force through pre-compression, an axial tube 3 configured to connect the disc spring set 1 in series and connect an axial pallet, a locking nut 6 that is screwed into the axial tube 3 to lock pre-pressure of the disc spring set, an axial pallet 4 configured to support the disc spring set 1 and connect an inverted U-shaped mild steel member 5, and an inverted U-shaped energy-dissipative mild steel member of which a plastic yielding region changes with load-displacement. For a structure of the restoring and energy-dissipation unit, refer to FIG. 12. The connecting unit includes a reinforcement-top connector 8 connected to a tensile reinforcement 12 through a reinforcement-top anchor head 13, a reinforcement-bottom connector 7 connected to the tensile reinforcement 12 through a reinforcement-bottom anchor head 14, and a top-end connector 10 and a bottom-end connector 9 that are connected to a to-be-reinforced structure. For a structure of the connecting unit, refer to FIG. 14. A cable reinforcement includes the high-strength tensile reinforcement 12, the reinforcement-top anchor head 13 connecting the tensile reinforcement 12 to the reinforcement-top connector 8, and the reinforcement-bottom anchor head 14 connecting the tensile reinforcement 12 to the reinforcement-bottom connector 7. For a structure of the cable reinforcement, refer to FIG. 13. The tensile reinforcement 12 may be a steel strand and an FRP reinforcement.

The disc spring set 1 is disposed on the axial pallet 4, the disc spring set 1 and the axial pallet 4 are placed together into an outer trough 2 that has been fixed. The reinforcement-top connector 8, the reinforcement-bottom connector 7 and the axial tube 3 are then sequentially sleeved on the tensile reinforcement 12, and an anchoring device is configured to anchor two ends of the tensile reinforcement are anchored by using the reinforcement-top anchor head 13 and the reinforcement-bottom anchor head 14 (refer to FIG. 13). Subsequently, the axial tube 3 is passed through the disc spring set 1 from the top of the outer trough 2 and is screwed into the upper end of the axial pallet 4. The axial tube 3 is tensioned to the pre-compression displacement of the disc spring set 1 and is screwed into the locking nut 6 to lock the pre-pressure of the disc spring set 1. The two inverted U-shaped mild steel members 5 that are designed according to an energy dissipation capacity are then separately disposed between the axial pallet 4 and the outer trough 2 and are connected by the high-strength bolts 11. Subsequently, the reinforcement-top connector 8 is connected to the top-end connector 10 in a screwed manner, the reinforcement-bottom connector 7 is connected to the axial tube 3 in a screwed manner, and the bottom-end connector 9 is connected to the outer trough 2. Finally, the top-end connector 10, the bottom-end connector 9, and the to-be-reinforced structure are connected by a pin-shaft, where the pin-shaft connection can satisfy an axial load-carrying requirement of the self-restoring energy-dissipative metal cable.

In the present invention, the self-centering cable with metal-based energy-dissipation is installed and used in the following manner:

1. Place the axial pallet 4 into the outer trough 2, and then, dispose the disc spring set 1 on a middle pallet of the axial pallet 4.

2. Sleeve the axial tube 3, the reinforcement-bottom connector 7 and the reinforcement-top connector 8 on the tensile reinforcement 12 sequentially, and then, the two ends of the tensile reinforcement 12 is anchored by using the reinforcement-top anchor head 13 and the reinforcement-bottom anchor head 14.

3. Pass the axial tube 3 from the top of the outer trough 2 to connect the disc spring set 1 in series, and screw the axial tube 3 into a screw-threaded upper end head of the axial pallet 4.

4. Fix the outer trough 2 and tension the axial tube 3 by using the force with the same size as the pre-pressure of the disc spring set 1, and then screw the locking nut 6 into a screw-threaded end of an outer tube of the axial tube 3 to lock the pre-pressure of the disc spring set 1.

5. Connect the inverted U-shaped mild steel member 5 to the axial pallet 4 and the outer trough 2 separately by using the high-strength bolts 11.

6. Pass the tensile reinforcement 12 through the reinforcement-bottom connector 7 and the reinforcement-top connector 8, and anchor the two ends of the tensile reinforcement 12 by using the reinforcement-top anchor head 13 and the reinforcement-bottom anchor head 14; and then screw the reinforcement-bottom connector 7 into the axial tube 3, screw the reinforcement-top connector 8 into the top-end connector 9, and connect the outer trough 2 and the bottom-end connector 10 by using the high-strength bolts 11.

What is claimed is:

1. A self-centering cable with metal-based energy-dissipation, comprising a restoring and energy-dissipation unit and a cable reinforcement connected to the restoring and energy-dissipation unit through a connecting unit, wherein the restoring and energy-dissipation unit comprises an outer trough, an axial tube disposed in an upper-end opening of the outer trough, two inverted U-shaped mild steel members arranged side by side and fixedly mounted in the outer trough, an axial pallet sandwiched by and fixedly connected to the two inverted U-shaped mild steel members, and a disc spring set disposed in the outer trough and sleeved on the axial tube; and the connecting unit comprises a reinforcement-bottom connector and a reinforcement-top connector, wherein the reinforcement-bottom connector and the reinforcement-top connector are disposed at an upper end of the axial tube, the cable reinforcement comprises a tensile reinforcement, a reinforcement-top anchor head and a reinforcement-bottom anchor head, wherein the reinforcement-top anchor head and the reinforcement-bottom anchor head are respectively disposed at an upper end and an lower end of the tensile reinforcement, the reinforcement-bottom connector is connected to the axial tube, the tensile reinforcement is anchored on the reinforcement-bottom connector through the reinforcement-bottom anchor head, and the tensile reinforcement is anchored on the reinforcement-top connector through the reinforcement-top anchor head.

2. The self-centering cable with metal-based energy-dissipation according to claim 1, wherein a lower end of the axial tube is connected to an end head of an upper end of the axial pallet in a screwed manner, a locking nut is mounted on the axial tube through an external screw thread provided at the upper end of the axial tube, a pre-pressure is applied to the disc spring set sleeved on the axial tube, and a compression amount and the pre-pressure of the disc spring set are adjusted by adjusting a length of the locking nut screwed into the axial tube.

3. The self-centering cable with metal-based energy-dissipation according to claim 1, wherein the two inverted U-shaped mild steel members are made of mild steel, are provided with holes at bottom ends of two side walls of the two inverted U-shaped mild steel members, and are mounted in the outer trough through a first group of high-strength bolts; the two inverted U-shaped mild steel members and the axial pallet sandwiched between the two inverted U-shaped mild steel members are connected as a whole through a second group of the high-strength bolts, and an energy dissipation capacity of the self-centering cable with metal-based energy-dissipation is adjusted by adjusting a wall thickness and a width of the two inverted U-shaped mild steel members.

4. The self-centering cable with metal-based energy-dissipation according to claim 3, wherein the axial pallet has a T-shaped cross-section, and the axial pallet comprises a vertical lower-end plate, a middle pallet disposed at a top of the lower-end plate and an end head disposed on an upper side of the middle pallet, wherein the middle pallet supports the disc spring set, the end head is provided with an external screw thread, and the lower-end plate is disposed between the two inverted U-shaped mild steel members and is connected to the two inverted U-shaped mild steel members through the second group of the high-strength bolts.

5. The self-centering cable with metal-based energy-dissipation according to claim 1, wherein a bottom-end connector is disposed on a bottom side of the outer trough, the reinforcement-top connector is connected to a top-end connector, and the bottom-end connector and the top-end connector are separately connected to a to-be-reinforced structure by using a pin shaft connection, to ensure axial force transmission of the tensile reinforcement.

6. The self-centering cable with metal-based energy-dissipation according to claim 1, wherein the axial pallet has a T-shaped cross-section, and the axial pallet comprises a vertical lower-end plate, a middle pallet disposed at a top of the lower-end plate and an end head disposed on an upper side of the middle pallet, wherein the middle pallet supports the disc spring set, the end head is provided with an external screw thread, and the lower-end plate is disposed between the two inverted U-shaped mild steel members and is connected to the two inverted U-shaped mild steel members through a second group of high-strength bolts.

7. The self-centering cable with metal-based energy-dissipation according to claim 2, wherein the axial pallet has a T-shaped cross-section, and the axial pallet comprises a vertical lower-end plate, a middle pallet disposed at a top of the lower-end plate and an end head disposed on an upper side of the middle pallet, wherein the middle pallet supports the disc spring set, the end head is provided with an external screw thread, and the lower-end plate is disposed between the two inverted U-shaped mild steel members and is connected to the two inverted U-shaped mild steel members through a second group of high-strength bolts.

8. The self-centering cable with metal-based energy-dissipation according to claim 2, wherein a bottom-end connector is disposed on a bottom side of the outer trough, the reinforcement-top connector is connected to a top-end connector, and the bottom-end connector and the top-end connector are separately connected to a to-be-reinforced structure by using a pin shaft connection, to ensure axial force transmission of the tensile reinforcement.

9. The self-centering cable with metal-based energy-dissipation according to claim 3, wherein a bottom-end connector is disposed on a bottom side of the outer trough, the reinforcement-top connector is connected to a top-end connector, and the bottom-end connector and the top-end connector are separately connected to a to-be-reinforced structure by using a pin shaft connection, to ensure axial force transmission of the tensile reinforcement.

* * * * *